United States Patent [19]

Takasuga et al.

[11] Patent Number: 4,966,221

[45] Date of Patent: Oct. 30, 1990

[54] METHOD OF PRODUCING ALUMINUM ALLOY CASTINGS AND PISTON MADE OF ALUMINUM ALLOY

[75] Inventors: Shunzo Takasuga; Yukihiro Sugimoto; Keiichiro Noguchi; Motohmi Urabe, all of Hiroshima, Japan

[73] Assignee: Mazda Motor Corporation, Hiroshima, Japan

[21] Appl. No.: 867,597

[22] Filed: May 27, 1986

Related U.S. Application Data

[63] Continuation of Ser. No. 609,876, May 14, 1984, abandoned.

[30] Foreign Application Priority Data

May 18, 1983 [JP] Japan ..... 58-87197
May 25, 1983 [JP] Japan ..... 58-92188

[51] Int. Cl.[5] ..... B22D 19/16
[52] U.S. Cl. ..... 164/120; 164/98
[58] Field of Search ..... 164/79, 91, 97, 98, 164/99, 100, 101, 102, 103, 112, 113, 120; 148/3, 127

[56] References Cited

U.S. PATENT DOCUMENTS

| | | | |
|---|---|---|---|
| 2,797,460 | 7/1957 | Whitfield | 164/98 |
| 3,523,766 | 8/1970 | Markus et al. | 164/79 |
| 3,853,635 | 12/1974 | Demendl | 164/97 |
| 4,318,438 | 3/1982 | Ban et al. | 164/97 |
| 4,334,507 | 6/1982 | Kohnert et al. | 164/120 |
| 4,452,865 | 6/1984 | Yamatsuta et al. | 148/3 |
| 4,492,265 | 1/1985 | Donomoto et al. | 164/108 |

FOREIGN PATENT DOCUMENTS

| | | | |
|---|---|---|---|
| 54-151715 | 11/1979 | Japan . | |
| 2106433A | 4/1983 | United Kingdom | 164/97 |

*Primary Examiner*—Richard K. Seidel
*Attorney, Agent, or Firm*—Sixbey, Friedman, Leedom & Ferguson

[57] ABSTRACT

Porous material of metal is held in a die and molten aluminum alloy is introduced into the die to surround the porous material. Thus, high-pressure squeeze casting is accomplished under an applied pressure of not lower than 400 Kg/cm$^2$ to form an aluminum alloy casting stock with the porous material cast therein. The casting stock is heated to and maintained at 450° to 550° C. for 1 to 10 hours, and an intermetallic compound layer of aluminum and the metal of the porous material is thereby formed on the boundary between the porous material and the aluminum alloy.

9 Claims, 4 Drawing Sheets x100 x100 x100 x100 x100 x100 x100

METHOD OF PRODUCING ALUMINUM ALLOY CASTINGS AND PISTON MADE OF ALUMINUM ALLOY

This application is a continuation of Ser. No. 609,876 filed May 14, 1986, now abandoned.

BACKGROUND OF THE INVENTION

1. Field of the Invention

This invention relates to a method of producing aluminum alloy castings and to a piston made of an aluminum alloy.

2. Description of the Prior Art

Generally, diesel engine pistons are made of a high-strength alloy of aluminum containing silicon (e.g., JIS AC8A) and having a small thermal expansion coefficient and high resistance to abrasion. Since the head of the piston is subjected to corrosion from pressurized fuel injected from a fuel injection nozzle, and the ring grooves of the piston are subjected to repeated loading by pressure from the piston rings corresponding to the pressure of the burning air-fuel mixture, it has been strongly desired to improve the high-temperature hardness of these parts, thereby improving resistance to abrasion (resistance to corrosion) and resistance to fatigue.

There has been known a method of improving the surface strength of an aluminum alloy casting in which the aluminum alloy is cast around a metal insert of a different metal by gravity casting or die casting. However, when the metal insert is a porous metal or metallic-fiber molding having continuous pores, molten aluminum alloy cannot penetrate into inner pores in the case of gravity casting, and accordingly, the aluminum alloy cannot be bonded on the surface of the metal insert with sufficient strength. Therefore, debonding and cracking are apt to occur when heat load acts thereon. On the other hand, in the case of die casting, though the bonding strength and packing density are improved, it is very difficult to prevent air from being entrapped in the castings. Since the castings blister due to expansion of the entrapped air when heated, it is difficult to heat-treat the castings in order to improve the strength of the aluminum alloy or to improve the resistance to abrasion and fatigue by forming an intermetallic compound or a solid phase diffusion layer.

In U.S. Pat. No. 4,334,507, there is disclosed another method in which an aluminum alloy is cast around a heat-resistant porous material insert such as a sintered material of Ni-Cr system by high-pressure squeeze casting. In this case, though the aluminum alloy can be charged into the pores of the porous material insert, the bonding force between the porous material insert and the aluminum alloy is still insufficient, and at the same time, the resistance to abrasion and fatigue cannot be sufficiently improved since substantially no intermetallic compound is formed and without the intermetallic compound, the sintered material cannot have sufficient high-temperature hardness.

In Japanese Unexamined Patent Publication No. 54(1979)-151715, there is disclosed another method in which porous metal material such as of nickel is dipped into molten aluminum to close the pores of the metal material on its surface, and is heat-treated to form a layer of a compound of nickel and aluminum on its surface, and around the insert material thus obtained is cast an aluminum alloy. Though the compound layer somewhat contributes to improvement in heat resistance and corrosion resistance in the castings in accordance with this method the bonding strength between the compound layer and the aluminum alloy is insufficient and furthermore, the effect of the compound layer on heat resistance (high-temperature hardness) and corrosion resistance is limited since the compound layer is formed only on the surface of the insert material.

In the art of producing pistons of aluminum alloy, there is a method in which a Ni-resist cast iron insert is alfin-treated and an aluminum alloy is cast around the insert of alfin-treated Ni-resist cast iron so that the insert forms the ring support portion of the piston, a ring groove being machined along the outer periphery of the ring support portion. In the alfin treatment, the Ni-resist cast iron insert is dipped into molten aluminum alloy and then an aluminum alloy is cast therearound with the aim of improving bonding strength between the aluminum alloy and the insert. However, the alfin treatment is troublesome and increases the manufacturing cost, while, at the same time, the bonding strength cannot be sufficiently improved. Furthermore, since when an alfin-treated material is heat-treated, debonding occurs between the alfin-treated layer and the aluminum alloy layer, it is difficult to solution-heat-treat (one kind of heat-treatment) the alfin-treated material in order to improve the mechanical properties of the aluminum alloy layer. Further, since Ni-resist cast iron has a low thermal conductivity, heat transmission from the piston to the cylinder wall is limited to adversely affect cooling of the piston.

SUMMARY OF THE INVENTION

In view of the foregoing observations and description, the primary object of the present invention is to provide a method of producing aluminum alloy castings having improved high-temperature hardness, resistance to abrasion and resistance to fatigue.

Another object of the present invention is to provide a method of producing aluminum alloy castings having a porous metal insert in an aluminum alloy in which the bonding strength between the insert and the aluminum alloy is highly improved.

The method of the present invention comprises the steps of holding porous material of metal in a die, introducing molten aluminum alloy into the die, accomplishing high-pressure squeeze casting under a pressure not lower than 400 $Kg/cm^2$ to form an aluminum alloy casting stock with the porous material cast therein, and maintaining the casting stock at 450° to 550° C. for 1 to 10 hours, thereby forming an intermetallic compound layer of aluminum and the metal of the porous material on the boundary between the porous material and the aluminum alloy.

The porous material may be foam of a metal such as nickel, copper or iron system, or moldings of metallic-fiber of such metals. When the aluminum alloy is cast around the porous material by high-pressure squeeze casting in which the molten aluminum alloy introduced into the die is permitted to solidify under a high pressure not lower than 400 $Kg/cm^2$ (e.g., 600 $Kg/cm^2$ or 1000 $Kg/cm^2$), the pores of the porous material are filled with the aluminum alloy. When the pressure is lower than 400 $Kg/cm^2$, the effect of the pressure on the structure and mechanical properties of the solidified aluminum alloy castings is insufficient, and the aluminum alloy and the porous material cannot be bonded with each other with sufficient strength, whereby it becomes difficult to form a satisfactory intermetallic compound layer of aluminum and the metal of the porous material on the boundary between the porous material and the aluminum alloy.

The porous material may be preheated before casting of aluminum alloy in order to improve packing.

The porous material may be of any shape and any volume fraction Vf. However, it is preferred that the porous material be of volume fraction Vf of 3 to 50%, i.e., of a porosity of 50 to 97%, with a volume fraction Vf of 5 to 40% being particularly preferable, and a volume fraction Vf of 10 to 30% being the most preferable. The volume fraction Vf is reduced with formation of the compound layer, and when the volume fraction Vf of the porous material is lower than 3%, the density of the compound layer formed on the surface and in the pores of the porous material is undesirably lowered. On the other hand, when the volume fraction Vf of the porous material is higher than 50%, the volume fraction of the compound layer is undesirably increased over 80%. Generally, it is preferred that the volume fraction of the compound layer of the metal of the porous material and aluminum formed on the boundary between the porous material and the aluminum alloy be in the range of 1 to 80% as will be described in detail later. Further, the pore size of the porous material is preferably in the range of 0.05 mm to 1 mm. When the pore size is smaller than 0.05 mm, it is difficult to fill the pores of the porous material with molten aluminum alloy, and on the other hand, when the pore size is larger than 1 mm, the density of the compound layer is undesirably lowered The compound layer formed between the porous material and the aluminum alloy is an intermetallic compound of aluminum and the metal of the porous material. That is, when the porous material is of a metal of nickel system, the intermetallic compound layer is of a compound of aluminum and nickel, when the porous material is of a metal of copper system, it is of a compound of aluminum and copper, and when the porous material is of a metal of iron system, it is of a compound of aluminum and iron. The intermetallic compound layer is formed by diffusion of metal of the porous material into the aluminum alloy.

In order to form the compound layer, the casting stock is maintained at 450° to 550° C. for 1 to 10 hours (This step will be referred to as "intermetallic compound forming step", hereinbelow.). When the heating temperature is lower than 450° C., it takes an uneconomically long time to form the intermetallic compound layer, and on the other hand, when the heating temperature is higher than 550° C., the strength of the aluminum alloy itself is lowered. When the heating time is shorter than one hour, sufficient intermetallic compound layer cannot be formed, while when the heating time is longer than ten hours, formation of the intermetallic layer is substantially saturated, and accordingly heating for more than ten hours is uneconomical.

In order to accomplish solution heat treatment simultaneously with the intermetallic compound forming step, hardening with water and tempering (e.g., T6 treatment) may be effected after heating the casting stock.

It is preferred that the volume fraction of the compound layer in the part including cast-in porous material be in the range from 1 to 80%. When the volume fraction is smaller than 1%, the high-temperature strength, the resistance to abrasion and the resistance to fatigue cannot be sufficiently improved. On the other hand, when the volume fraction is larger than 80%, the bonding strength between the porous material and the aluminum alloy matrix upon application of thermal stress and the like is lowered due to shortage of the aluminum alloy, and at the same time, the hardness of the product is undesirably increased so that the machining workability thereof is lowered. Further, in order to improve the high-temperature strength, the resistance to abrasion and the resistance to fatigue, it is preferred that the thickness of the intermetallic compound be not smaller than 10$\mu$.

Further, the total thickness of the intermetallic compound layer and the porous material layer is preferred to be not smaller than 0.1 mm since when the total thickness is smaller than 0.1 mm, the improved resistance to abrasion and fatigue cannot be maintained long.

In accordance with the method of the present invention, the bonding strength between the porous material and the aluminum alloy cast therearound can be substantially improved since the porous material is brought into close contact with the aluminum alloy therearound by virtue of high-pressure squeeze casting and the intermetallic compound layer is formed between the porous material and the aluminum alloy. Further, since the intermetallic compound layer which is superior in heat resistance and high-temperature hardness extends deep into the porous material, the resistance to abrasion and fatigue of the product can be substantially improved to ensure good durability of the same.

The method of the present invention is particularly useful for making pistons of aluminum alloy, and accordingly still another object of the present invention is to provide an improved piston of aluminum alloy which has a high thermal conductivity and the piston ring support portion of which has improved high-temperature hardness, i.e., high resistance to abrasion and fatigue.

The piston in accordance with the present invention includes a ring support portion or a wall portion defining a ring groove which comprises a porous material of metal cast in a piston body of an aluminum alloy, with the aluminum alloy penetrating into pores of the porous material, and an intermetallic compound layer of aluminum and the metal of the porous material being formed on the boundary between the porous material and the aluminum alloy, wherein the volume fraction of the compound layer is in the range of from 1 to 80%. Preferably the volume fraction of the compound layer is in the range of 5 to 30% in view of the bonding strength between the porous material and the aluminum alloy, and the heat conductivity.

In the piston of the present invention, both the resistance to abrasion and the resistance to fatigue of the ring support portion are substantially improved by virtue of the intermetallic compound layer which is formed on the boundary between the porous material and the aluminum alloy and has a high heat resistance and an excellent high temperature hardness. Accordingly, the piston of the present invention can withstand repeated loading due to the pressure of burning air-fuel mixture. Further, since solution heat treatment of the aluminum alloy can be conducted without adversely affecting the properties of the ring support portion, and piston body can be solution-heat-treated (T6 treatment, T7 treatment, for example) to improve the mechanical strength thereof, i.e., resistance to thermal shock and resistance to fatigue. Further, since the pores of the porous material are filled with the aluminum alloy, good heat conductivity of the piston can be ensured.

DESCRIPTION OF THE PREFERRED EMBODIMENTS

Figure 1:
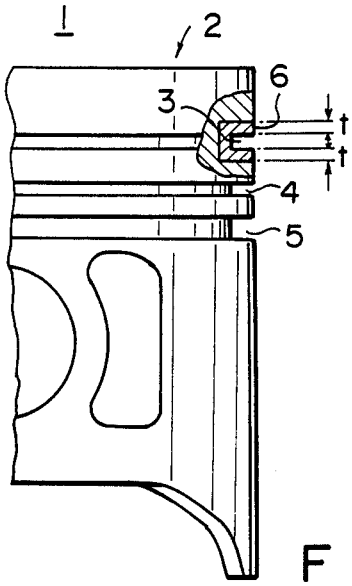
FIG. 1 is a fragmentary side view partly in cross-section of a piston for a diesel engine in accordance with an embodiment of the present invention.

FIG. 1 shows a piston for a diesel engine in accordance with an embodiment of the present invention. The piston 1 is made of an aluminum alloy and comprises a piston body 2 and three ring grooves 3, 4 and 5 formed in the outer peripheral surface of the piston body 2, the uppermost groove being a top ring groove for receiving a top ring (not shown), the middle groove being a secondary ring groove for receiving a secondary ring (not shown), and the lowermost groove being an oil ring groove for receiving an oil ring (not shown).

The secondary ring groove 4 and the oil ring groove 5 are formed by machining the aluminum alloy portion of the piston body 2, while the top ring groove 3 is formed by machining a top ring support portion which is formed of a ring-like porous insert material 6 of metal cast in the aluminum alloy.

Figure 2:
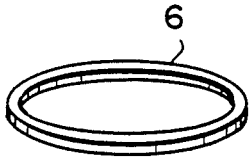
FIG. 2 is a perspective view of the porous insert material which is employed in manufacturing the piston of FIG. 1.
Figure 3:
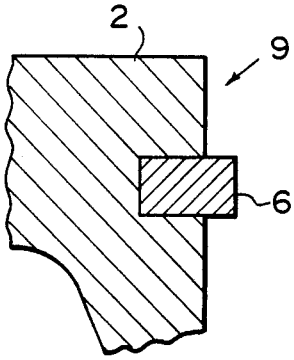
FIG. 3 is a fragmentary cross-sectional view of a die casting stock.

That is, the ring-like porous insert material 6 is initially first formed of metal without being provided with any groove, as shown in FIG. 2. The insert material 6 is held in place in a die 7 comprising upper, lower and intermediate portions 7*a*, 7*b* and 7*c* as shown in FIG. 3. Molten aluminum alloy is introduced into the cavity 8 of the die 7 from a gate 7*d* formed in the lower portion 7*b* thereof, and is permitted to solidify with a high pressure not lower than 400 Kg/cm$^2$ being continuously applied to the molten aluminum until it solidifies.

Figure 4:
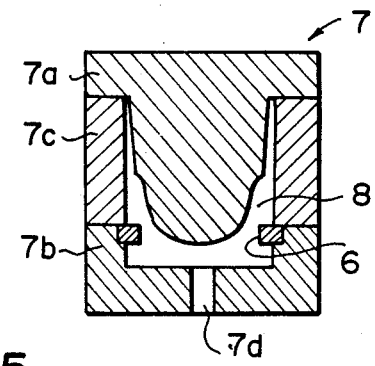
FIG. 4 is a cross-sectional view of a die employed in manufacturing the piston of FIG. 1.

A casting stock 9 having the ring-like insert material 6 cast in the body 2 as shown in FIG. 4 is thus obtained. In this state, the pores of the insert material 6 are filled with the aluminum alloy. Then the casting stock 9 is heated in an oven to 450° to 550° C. and maintained at such temperature for 1 to 10 hours to form an intermetallic compound layer of aluminum and the metal of the porous insert material 6 on the boundary between the insert material and the aluminum alloy. If desired, solution heat treatment of the aluminum alloy matrix may be effected simultaneously with or after the intermetallic compound forming step. Finally, the top ring groove 3 is machined in the outer peripheral surface of the porous insert material 6 and the secondary ring groove 4 and the oil ring groove 5 are machined in the peripheral surface of the aluminum alloy portion of the piston body 2 as shown in FIG. 1.

Figure 5:
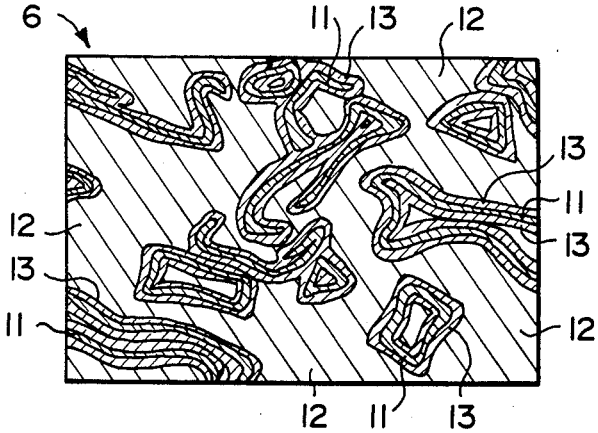
FIG. 5 is an enlarged schematic cross-sectional view showing the microstructure of a part of the cast-in porous insert material.
Figure 6:
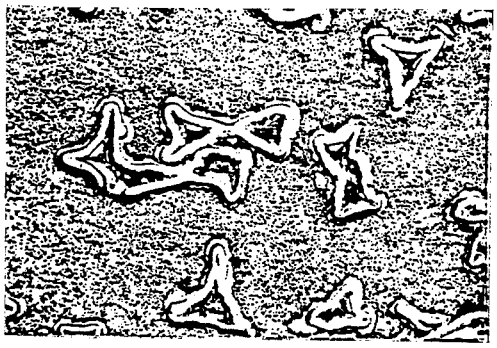
FIGS. 6 to 12 are photomicrographs respectively showing the microstructure of aluminum alloy casting in accordance with several embodiments of the present invention.

FIG. 5 is an enlarged schematic cross-sectional view showing the microstructure of the part of the cast-in porous insert material 6. In FIG. 5, reference numerals 11, 12 and 13 respectively denote metal of the porous insert material 6, the aluminum alloy and the intermetallic compound formed on the boundary between the aluminum alloy and the porous insert material 6. In accordance with the present invention, the volume fraction of the intermetallic compound 10 should range from 1 to 80% as described above. Preferably, the porous insert material 6 is foam of a metal of nickel system, copper system or iron system, or moldings of metallic-fiber of such a metal. Preferably, the porous insert material 6 has continuous pores extending inwardly from the surface thereof so that the molten aluminum alloy can penetrate deep into the pores.

The thickness t (FIG. 1) of the top ring support portion (the porous insert material 6) after machining the top ring groove 3 is generally 2 mm to 3 mm and should not be less than 0.1 mm. Otherwise, heavy load from the top ring is directly applied to the aluminum alloy portion of the piston body 2 which consequently suffer fatigue.

Ten aluminum alloy castings (first to tenth) were prepared in different conditions shown in the following table in accordance with the method of the present invention.

| | No. 1 | No. 2 | No. 3 | No. 4 | No. 5 | No. 6 | No. 7 | No. 8 | No. 9 | No. 10 |
|---|---|---|---|---|---|---|---|---|---|---|
| Al alloy matrix | AC8A | AC8A | AC8A | AC8A | AC8A | AC8A | AC8A | AC8A | AC8A | AC8A |
| porous material | Ni foam | Ni foam | Ni foam | Ni foam | Ni foam* | Ni foam | Ni foam | Ni foam | Ni foam | Ni foam* |
| Vf | 3% | 10% | 20% | 50% | 10% | 5% | 10% | 20% | 20% | 10% |
| applied pressure Kg/cm$^2$ | 1000 | 1000 | 1000 | 1000 | 600 | 400 | 1000 | 1000 | 1000 | 600 |
| intermetal forming step | | | | | | | | | | |
| temp. | 500° C. | 500° C. | 515° C. | 515° C. | 500° C. | 500° C. | 500° C. | 500° C. | 500° C. | 500° C. |
| time | 2 Hr | 4 Hr | 6 Hr | 8 Hr | 4 Hr | 4 Hr | 1 Hr | 4 Hr | 10 Hr | 4 Hr |
| hardening | water | water | water | water | water | water | water | water | water | water |
| temper | 180° C. × 6 Hr | 180° C. × 6 Hr | 180° C. × 6 Hr | 180° C. × 6 Hr | 180° C. × 6 Hr | 180° C. × 6 Hr | 180° C. × 6 Hr | 180° C. × 6 Hr | 180° C. × 6 Hr | 180° C. × 6 Hr |
| intermetallic compound layer composition | Ni—Al | Ni—Al | Ni—Al | Ni—Al | Cu—Al | Ni—Al | Ni—Al | Ni—Al | Ni—Al | Cu—Al |
| Vf | 1% | 7.5% | 40% | 80% | 10% | 3% | 5% | 15% | 40% | 10% |
| residual porous | 2% | 6% | 10% | 25% | — | — | — | — | — | — |

-continued

| | No. 1 | No. 2 | No. 3 | No. 4 | No. 5 | No. 6 | No. 7 | No. 8 | No. 9 | No. 10 |
|---|---|---|---|---|---|---|---|---|---|---|
| Ni material Vf | | | | | | | | | | |

*plated with Cu

The composition of the aluminum alloy (JIS AC8A) used for the first to fifth castings was as follows, wherein % is by weight.

| | | | |
|---|---|---|---|
| Al | 84.23%, | Cu 1.0%, | Si 12.2%, |
| Mg | 1.1%, | Fe 0.17%, | Ni 1.3% |

The composition of the aluminum alloy (JIS AC8A) used for the sixth to tenth castings was as follows, wherein % is by weight.

| | | | |
|---|---|---|---|
| Al | 84.88%, | Cu 1.0%, | Si 11.9%, |
| Mg | 0.9%, | Fe 0.22%, | Ni 1.1% |

The porous materials (Ni foam) used for the fifth and tenth castings were plated with Cu to a thickness of 5 to 10μ.

FIGS. 6 to 12 are photomicrographs respectively showing the microstructure of the second and fifth to tenth castings.

Figure 7:
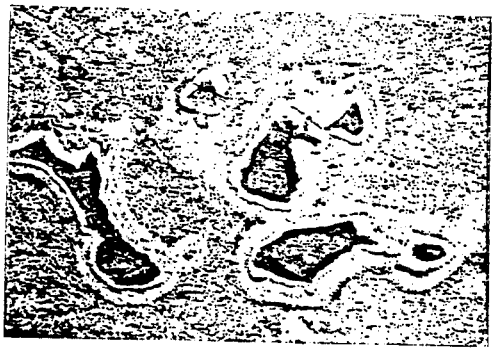
Figure 8:
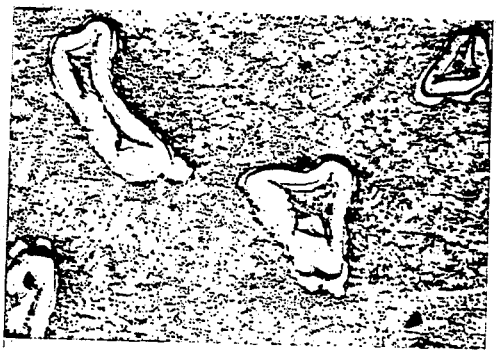

In the photomicrographs of FIGS. 6 and 8 to 11, the spotted matrix constituting the major area is the aluminum alloy 12, and the white layers bounded by gray layers are of residual porous material of nickel 11. The gray layers (Ni rich) and the white layers (Al rich) formed along the outer periphery of the residual porous material of nickel 11 are of the intermetallic compound 13. The black portions inside the portions of the residual porous material portions in FIGS. 6 and 9 to 12 are of graphite which adhered to the porous material of nickel 11 in the manufacturing process thereof. In FIGS. 7 and 12, the spotted matrix constituting the major area is the aluminum alloy 12, the white layers are of residual porous layers of nickel 11, and the gray layers bounding the white layers are of copper plated on the porous material. Further, the light gray layers (Cu rich) and the lighter gray layers (Al rich) are of the intermetallic compound 13.

Figure 9:
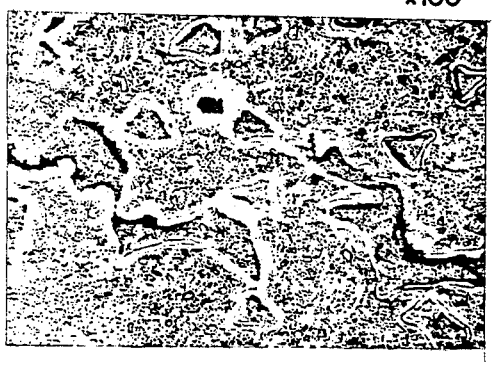
Figure 10:
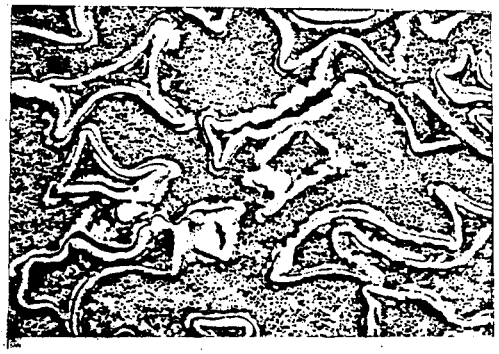

In FIG. 9, the amount of the residual porous material of nickel is smaller than the amounts in the other figures. This is because the wall thickness of the porous material used for the seventh casting was small and accordingly substantial part of the porous material was combined with aluminum to the form the intermetallic compound after heating for one hour.

Figure 11:
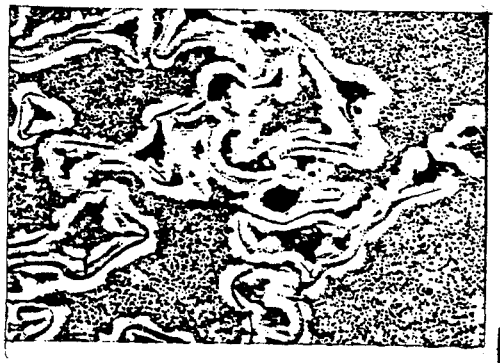
Figure 12:
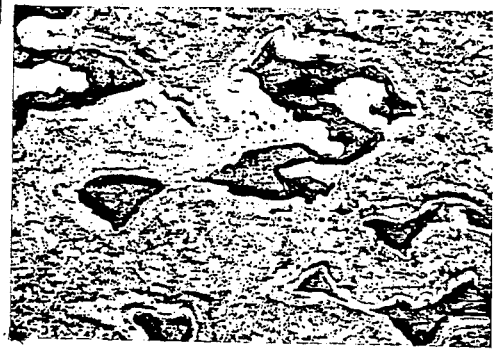

The entirely blackened inner portions of the porous material clearly shown in FIG. 11 are closed spaces in which aluminum alloy does not exist.

Figure 14:
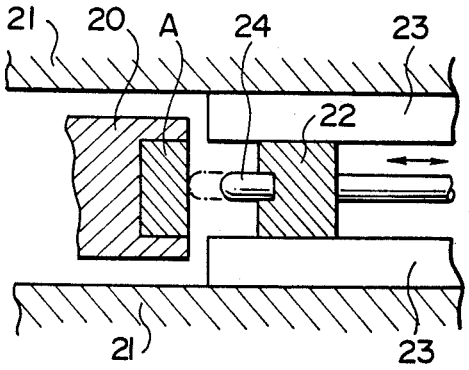
FIG. 14 is a schematic fragmentary cross-sectional view showing the device for carrying out the fatigue test.

The fatigue test was carried out as follows. Cylindrical test pieces were made of the first to fifth castings of the present invention, aluminum alloy (JIS AC8A), and Ni-resist cast iron. The diameter and the length of each test piece were 28 mm and 15 mm, respectively. Each test piece was held on a holder 20 provided in a heat insulating oven 21 of a test device shown in FIG. 14 as indicated at A. An abutment member 24 having a spherical end portion was secured to a plunger 22 slidable back and forth along a pair of guides 23. The spherical end portion having a diameter of 10 mm was repeatedly pressed against the surface of the test piece A 500,000 times at the cycle rate of 1,200 times a minute, and thereafter the diameter or the depth of the recess formed on the surface of each test piece was measured. The load applied to the test piece in each cycle was 20 Kg and the preload was 5 Kg. The fatigue test took about seven hours per test piece.

Figure 13:
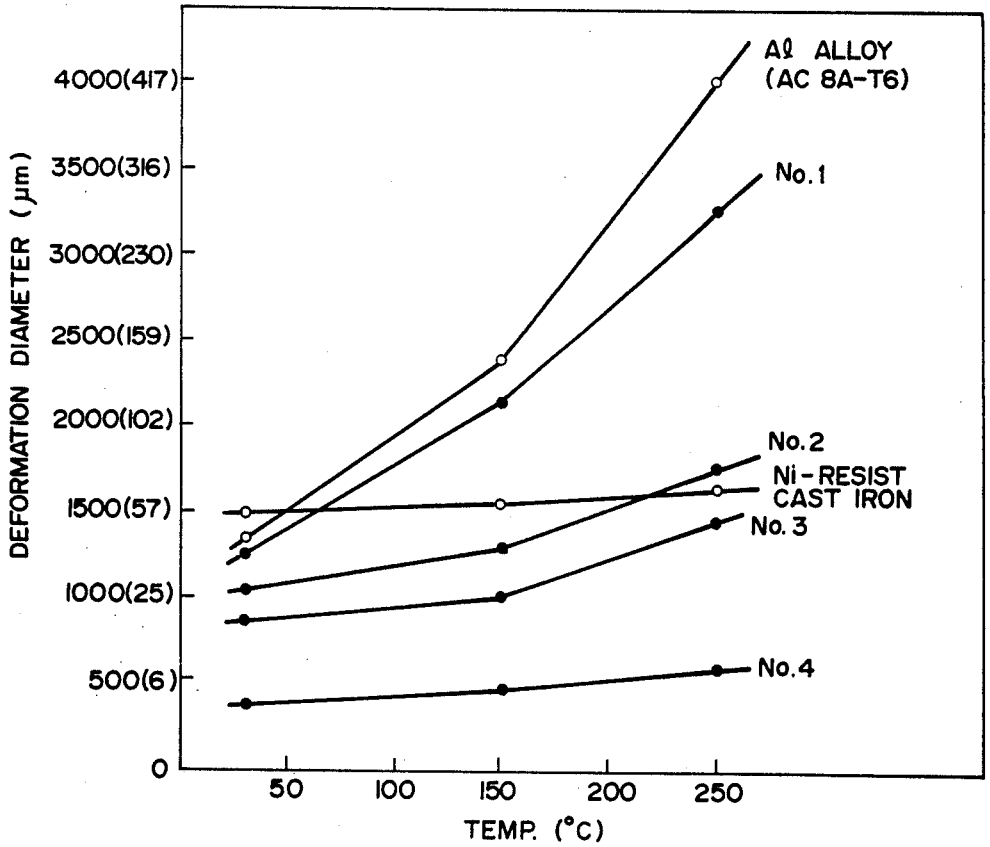
FIG. 13 is a graph showing the result of a fatigue test.

The result of the fatigue test is shown in FIG. 13. As can be seen from FIG. 13, the diameter of the recess becomes smaller as the volume fraction Vf of the intermetallic compound (see above table) increases, i.e., as the volume fraction Vf of the intermetallic compound in the castings of the present invention increases, the resistance to fatigue is improved.

Hardness, thermal conductivity and melting point of the intermetallic compound are as follows.

| | hardness | | thermal conductivity (25° C.) (Cal./cm · sec °C.) | melting point (°C.) |
|---|---|---|---|---|
| | normal temp. | 250° C. | | |
| AC8A-T6* | 137 | 39.3 | 0.37 | 577** |
| Ni-resist | 122 | 121 | 0.095 | |
| Ni—Al | 380–520 | 390–530 | 0.22 Ni | 850–1640 |
| Cu—Al | 570–730 | 550–700 | 0.94 Cu | 590 |
| Fe—Al | 1000–1200 | 1000–1200 | 0.18 Fe | 1140–1180 |

*500° C. × 4 Hr → hardening with water → 180° C. × 6 Hr
**eutectic point of Si and Al As can be understood from the description above, in the aluminum alloy castings of the present invention, the intermetallic compound having high heat resistance is formed in high density to form the skeleton of the castings. Therefore, even if the casting is heated above the melting point of the aluminum alloy, the aluminum alloy is prevented from being locally fused by virtue of the existence of the intermetallic compound, whereby high-temperature hardness is improved and the resistance to abrasion and fatigue can be improved.

We claim:

1. A method of producing aluminum alloy piston castings having ring-like ring support portions comprising the steps of holding a ring-like porous material in a piston die in a position corresponding to the ring support portion of the piston, said porous material being a metal selected from the group consisting of Ni, Cu and Fe, said porous material having a volume fraction in the range of from 3 to 50%;

introducing molten aluminum alloy into the die;

high-pressure squeeze casting said molten aluminum alloy under an applied pressure of not lower than 400 Kg/cm$^2$ to form an aluminum casting stock with said porous material therein; and maintaining the casting stock at 450° to 500° C. for 1 to 10 hours so that an intermetallic compound layer of aluminum and said metal of the porous material is formed on the boundary between the porous material and the aluminum alloy, said intermetallic compound having a hardness of at least 380 HV.

2. A method as defined in claim 1 in which the volume fraction of said porous material is in the range of from 5 to 40%.

3. A method as defined in claim 2 in which the volume fraction of said porous material is in the range of from 10 to 30%.

4. A method as defined in claim 1 in which said porous material is foam of metal.

5. A method as defined in claim 4 in which the pore diameter of said foam of metal is 0.05 mm to 1 mm.

6. A method as defined in claim 1 in which said porous material is preheated before being held in said die.

7. A method as defined in claim 1 further comprising a step of solution-heat-treating the casting stock.

8. A method as defined in claim 7 further comprising a step of tempering the casting stock after said step of solution heat treatment.

9. A method as in claim 1 wherein the volume fraction of the intermetallic compound in the ring support portion is in the range of 1–80%.

* * * * *